United States Patent [19]

Friesen

[11] Patent Number: 4,984,406

[45] Date of Patent: Jan. 15, 1991

[54] BUILDING PANEL

[76] Inventor: Peter Friesen, R.R. #1, Box 314, Group 24, Winkler, Manitoba, Canada, R0G 2X0

[21] Appl. No.: 297,465

[22] Filed: Jul. 17, 1989

[30] Foreign Application Priority Data

Jan. 14, 1988 [GB] United Kingdom ..... 880073

[51] Int. Cl.[5] ..... E04B 2/72; E04C 2/38; E04C 2/20; E04D 3/32

[52] U.S. Cl. ..... 52/594; 52/284; 52/309.2; 52/309.16; 52/529; 52/583; 52/588; 52/630

[58] Field of Search ..... 52/593, 594, 595, 588, 52/589, 591, 309.8, 309.9, 406, 309.2, 309.16, 529, 530, 284, 583, 92

[56] References Cited

U.S. PATENT DOCUMENTS

| | | | |
|---|---|---|---|
| 3,236,014 | 2/1966 | Edgar | 52/593 |
| 3,286,423 | 11/1966 | Donlon | 52/593 |
| 3,392,497 | 7/1968 | Cushman | 52/595 |
| 3,685,228 | 8/1972 | Pauley . | |
| 3,817,011 | 6/1974 | Weed . | |
| 3,886,751 | 6/1975 | Labora | 52/594 |
| 4,259,028 | 3/1981 | Cook . | |
| 4,304,080 | 12/1981 | Freeman . | |
| 4,499,645 | 2/1985 | Luomanen . | |
| 4,575,981 | 3/1986 | Porter . | |
| 4,612,741 | 9/1986 | Jacobson . | |
| 4,621,467 | 11/1986 | Golden . | |
| 4,743,485 | 5/1988 | Ting . | |

FOREIGN PATENT DOCUMENTS

| | | | |
|---|---|---|---|
| 2641826 | 3/1978 | Fed. Rep. of Germany | 52/309.9 |
| 593448 | 11/1977 | Switzerland | 52/594 |
| 1065579 | 4/1967 | United Kingdom . | |
| 2178725A | 2/1987 | United Kingdom . | |
| 2188345A | 9/1987 | United Kingdom . | |

*Primary Examiner*—Michael Safavi

*Attorney, Agent, or Firm*—Adrian D. Battison; Stanley G. Ade; Murray E. Thrift

[57] ABSTRACT

A building system includes a plurality of building panels which are connected together to form a wall structure and are then connected to roof panels to form a roof structure. Each of the panels is formed by rotational molding to form a hollow body. The hollow body can be filled with a foamed insulation material. Side edges of the hollow body include either a projection or a correspondingly shaped recess which has a web and a bulbous part of increased width on the outer end of the web so that the panels can be connected only by longitudinal sliding movement. Metal plates are embedded in the top and bottom surfaces for connection to metal plates in the roof panels and to a footing respectively. A rib on the front surface of the panel has a width of the order of one third of the width of the panel and extend from the front surface of the panel substantially equal to the thickness of the panel so as to provide sufficient longitudinal strength in the panel that the weight of the roof can be supported wholly upon the panels. Corner, window and door panels are provided to complete the system.

17 Claims, 2 Drawing Sheets

FIG. 1
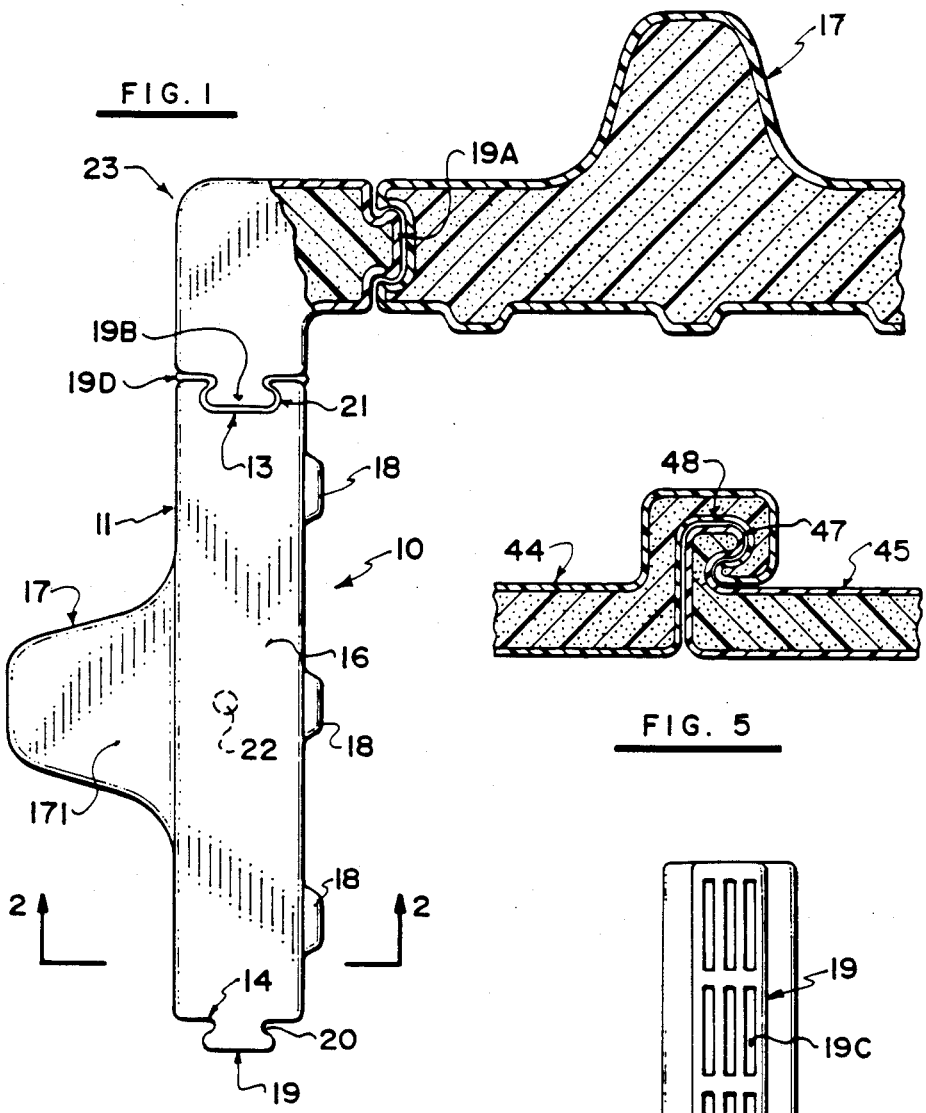
FIG. 5
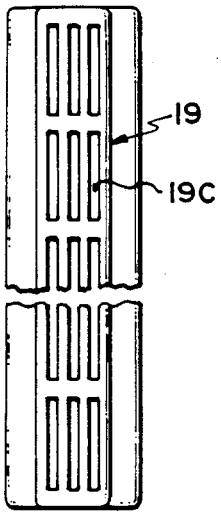
FIG. 6

FIG. 2
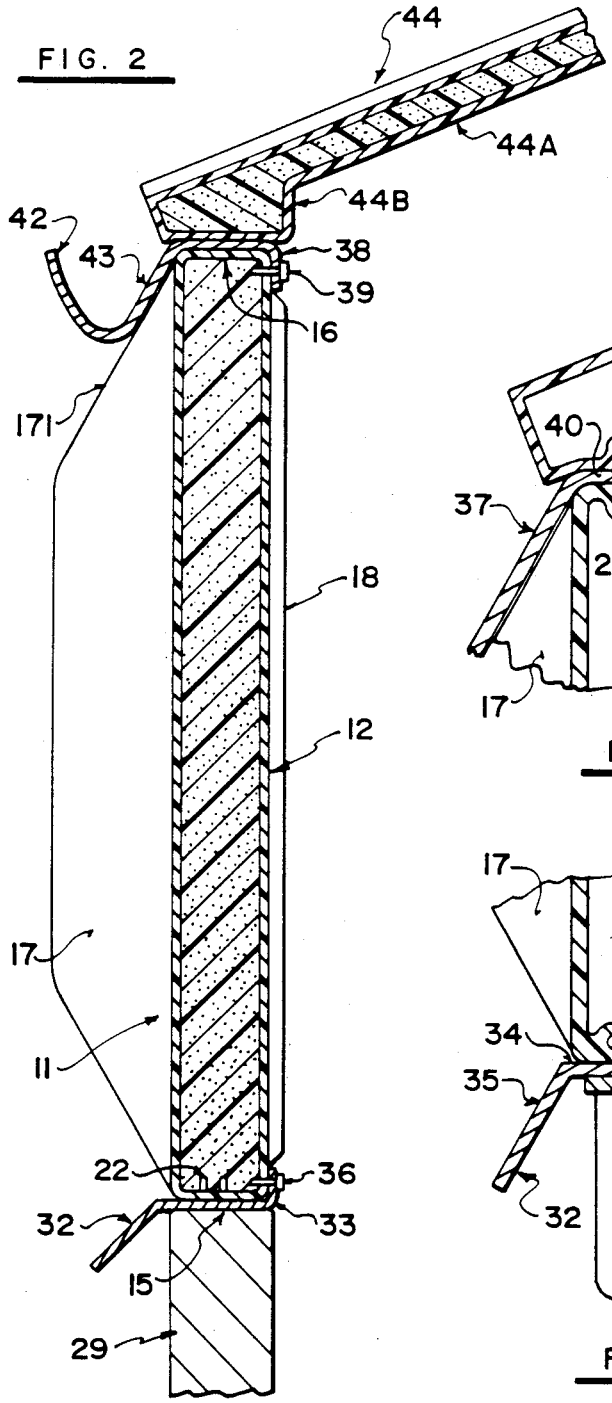
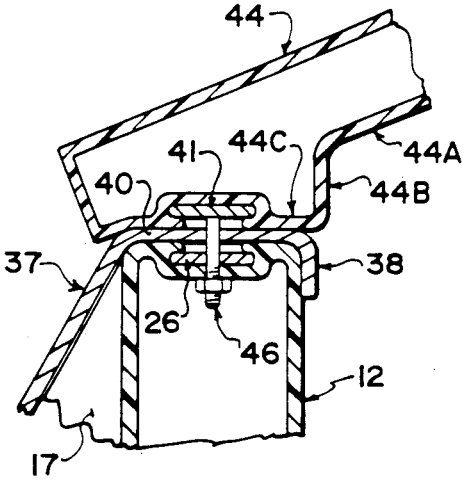
FIG. 4
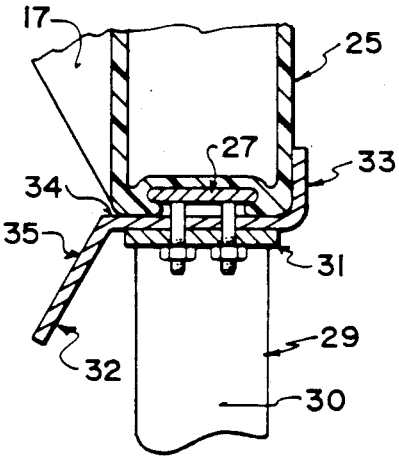
FIG. 3

BUILDING PANEL

BACKGROUND OF THE INVENTION

This invention relates to a building panel and particularly to a building panel which is integrally molded from a synthetic plastics material preferably using rotational molding techniques.

Various building techniques are available for building prefabricated type structures including various types of wooden panels, prestressed concrete panels, and steel panels. In many cases the building structure requires an initial steel frame which is then clad with suitable panels. Prestressed concrete has become prevalent in many of the city developments. In industrial locations steel frame buildings with steel cladding have become common. One problem with steel cladding is of course the necessity to insulate the building and attempts are being made to economically manufacture steel panels which include an outer steel skin, an inner steel skin and a structure of urethane foam material bridging and structurally uniting the steel skins. However to date such arrangements have not achieved significant commercial success.

The requirement remains therefore for an improved building structure which enables a prefabricated building to be cheaply, quickly and simply assembled using inexpensive panels and frame components which can be assembled by unskilled labor and yet provide a building resistant to the elements.

SUMMARY OF THE INVENTION

According to a first aspect of the invention, therefore, there is provided a building panel comprising a panel body integrally molded from a synthetic plastics material, said panel body having an outer wall substantially wholly enveloping a hollow interior and defining a top, a bottom, sides, a front surface and a rear surface, each of said sides having either a recess or a projecting portion longitudinally of the respective side and shaped such that the projecting portion and recess are correspondingly shaped and can only be interconnected by sliding movements in a longitudinal direction of one panel along a next adjacent panel.

According to a second aspect of the invention, therefore, there is provided a building system comprising a plurality of building panels, each building panel comprising a panel body integrally molded from a synthetic plastics material, said panel body having an outer wall substantially wholly enveloping a hollow interior and defining a top surface, two side surfaces, a front surface and a rear surface the panels each having a height sufficient to extend from a floor level to a roof level of a building, the front surface of at least some of the panels including a rib projecting outwardly from the front surface to provide structural strength for the panel so that vertical strength of a wall of a building can be provided solely by the panels, each panel having connecting means on the side surfaces thereof for connection to an adjacent side surface of an adjacent panel.

Preferably the panel is formed by rotational molding to form a substantially fully closed part with the rotational molding technique arranged to generate a wall thickness which is substantially constant and relatively thin relative to the dimensions of the part.

Preferably the part has a hole molded into an outer surface generally molded at the top or the bottom for the injection of a foaming material so that the hollow interior can be filled with a suitable insulating foam for example urethane foam.

Preferably either the front surface or the rear surface includes a rib longitudinally of the surface with the rib projecting outwardly from the surface a significant distance which may be equal to or greater than the thickness of the part so as to provide longitudinal structural strength for the part and to provide bending resistance for the surface. Preferably the rib is arranged centrally of the surface and has a transverse width of the order of one quarter to one third of the width of the panel. The rib can be tapered in height at the upper and lower ends of the rib so as to converge to the top and bottom of the part. The other of the front and rear surfaces may include a plurality of ribs of very much less height to allow the attachment of strapping or other facing material on that surface of the panel.

Preferably the projecting portion and recess are continuous along the sides and are commonly shaped defining a web and a curved bulbous part attached to the web. The projecting portion is similarly hollow and is formed by a molding technique in which the mold can pivot as it opens to allow the escape of the molded part.

Preferably the building panel is part of a building system including corner pieces which are similarly molded and which are cranked at a suitable angle for example a right angle to define side surfaces which cooperate with the sides of the panels. The side surfaces of the corner piece also include either a projection or a recess depending upon requirements.

Preferably the panels of the building system will have one or more metal inserts molded into the top and bottom surfaces of the panel. The panel can then be bolted at its lower end to a suitable footing support structure at its upper end to a roof panel constructed in the same manner.

Preferably the height of the panel is sufficient to extend directly from floor level to a roof level with the bottom of the panel generally being flat and horizontal and the upper end of the panel being flat but inclined at the angle of the roof.

Roof pieces are manufactured generally in the same manner but have the integrally molded insert projecting from a lower surface adjacent but spaced from one end of the panel so as to cooperate with the vertical wall. While the projecting portions of the wall panels are generally simple projections and recesses extending directly outwardly from the sides, in regard to a roof panel, the recesses and projecting portions include at least one surface which extends vertically upwardly from the upper or outer surface of the roof panel so as to prevent moisture wicking through the joint.

One embodiment of the invention will now be described in conjunction with the accompanying drawings in which:

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

FIG. 1 is a vertically downward view of two panels of the building system according to the invention including a corner piece with part of the view shown in plan and part in cross section.

FIG. 2 is a cross sectional view along the lines 2—2 of FIG. 1.

FIG. 3 is a cross sectional view similar to that of FIG. 2 on a slightly enlarged scale showing the cooperation between a bottom end of one of the panels and a footing support structure and particularly showing a panel incorporating an integral metal insert.

FIG. 4 is a view similar to that of FIG. 3 showing the cooperation between the upper end of the panel of FIG. 3 with a roof panel.

FIG. 5 is a cross sectional view longitudinally of a roof panel showing the structure of the joint or connection between the roof panels.

FIG. 6 is a partial side elevational view of a panel of FIG. 1.

In the drawings like characters of reference indicate corresponding parts in the different figures.

DETAILED DESCRIPTION

A single panel is best shown in FIGS. 1 and 2 and comprises an integrally molded hollow body generally indicated at 10 and including an outer surface 11, an inner surface 12, sides 13 and 14, bottom 15 and a top 16. Each of those surfaces is formed from a thin wall of molded plastics material generally molded by the rotational molding technique which provides a thin wall with a hollow interior. In rotational molding, the part is continuously rotated so as to lay down the plastics material on the inner surface of the mold to form a wall surface which is generally of substantially constant thickness and relatively thin compared to the dimensions of the part so formed.

On the outer surface 11 is formed a rib 17 which projects outwardly from the outer surface by a distance substantially equal to or slightly greater than the thickness of the part and which has a transverse dimension of the order of one quarter to one third of the width of the part. In this way the rib forms a structural strengthening member providing subtantial vertical structural strength to the part and in addition limiting or eliminating any flexing or bending of the outer surface. The rib is suitably formed as an integral part of the panel with the thin wall as previously described.

On the inner surface 12 is formed a plurality of vertical ribs 18 which are very much less in size both transversely and in depth than the rib 17. The ribs 18 provide bending resistance to the inner surface 12 and in addition form raised portions to which strapping or other inner surfacing of the building can be attached.

The side 14 includes a projecting portion 19 which includes a web 20 and a bulbous projecting end wider than the web 20 and generally having smoothly curved sides to allow it to be readily formed in a mold which pivots into an open condition to allow release of the completed molded panel. The projection as shown at 19A in relation to the corner piece is hollow and molded in the same manner as the remainder of the panel.

The side 13 of the panel includes a recess indicated at 21 which is shaped in a manner substantially identical to that of the projection 19 so they cooperate to hold adjacent panels in side to side position with the only manner of connecting the panels being a sliding movement longitudinally of the panels. When connected therefore the panels are held rigidly coupled and prevented from movement in a direction transversely to the joint or in a direction inwardly and outwardly of the joint.

At the time of molding the panel, the panel is formed with an opening 22 in one end face and in the example shown this is positioned in the bottom face. In the manufacturing technique, a foaming material can be poured through the opening 22 so as to generate a foam within the hollow interior of the panel which fills the panel so as to generate an insulation of the panel. For this purpose urethane foam is conventionally employed and can be satisfactorily employed in this technique.

Turning now to FIG. 6, an end face of the projecting portion 19 of one of the panels is shown in side elevation. Subsequent to the injection of the foam into the panel, a plurality of slots 19C are formed in the end face of the projection 19. Similarly slots are formed in the side surface containing the recess generally in the area of the recess 13. The slots in one example extend approximately six inches in length and are spaced from the next adjacent longitudinal slot by a portion of the wall which is not so slotted and extends approximately over one inch. The slots are arranged in rows longitudinal of the projection and are of a depth to cut through the thickness of the wall just to expose the foam material on the inside of the panel.

The dimensions of the recess are arranged to be slightly greater than the dimensions of the projecting portion. This enables ready sliding movement in a longitudinal direction. More importantly a clearance is formed of the order of one quarter inch which can receive an injected foam material 19D which is the same as or compatible with the foam material inside the foam panel. The injection foam material 19D between the two panels thus acts to bond to the exposed foam material at the projecting portion 19 and in the recess 13 to form an effective bond extending across from one panel to the next adjacent panel and forming an effective insulation layer similarly extending across the space between the panels so the insulation is substantially continuous.

A corner piece is indicated generally at 23 and comprises a generally right angled piece which is of a thickness substantially equal to the thickness of the panel at its part spaced from the rib 17. On the side edges of the corner piece 23 are provided as shown projections 19A and 19B which cooperate with recesses in the adjacent sides of the adjacent panels. The corner piece 23 can be manufactured with recesses on each of its side edges to provide flexibility of construction to enable formation of inside 90° corners as shown in FIG. 1 and outside 90° corners which are the type 180° offset from the type shown in FIG. 1.

The panels shown in FIG. 1 and FIG. 2 consist solely of the outer skin formed by the molding technique together with the injection of the foam. In some cases panels can be used without foam if the insulation effect is not required.

In FIGS. 3 and 4 there is shown cross sectional views of the upper and lower portions of the panel of FIGS. 1 and 2. At a lower end of the panel indicated at 25 is molded a plate 27 which is embedded in the plastics material of the bottom surface. At an upper end is embedded a plate 26 which lies in the top surface. The rotational molding techniques by which embedded plates can be integrally molded into the part are well known. A surface of each of the plates is exposed for connection of the plate as described hereinafter. In order to most effectively connect the panel to the roof structure and to the footing, a pair of the embedded plates is provided with each plate being arranged adjacent one end of the top and bottom surfaces respectively.

A footing generally indicated at 29 is of suitable construction which will not be described here as it is conventional and can vary according to requirements. In the embodiment shown, the footing comprises a post or pile 30 which includes an upper plate 31 generally conforming in shape to the plate 27 at the bottom of the panel so that the plates can be bolted together to maintain the panel properly located on the footing. The shape of the panel is arranged to provide sufficient vertical strength that the panel thus located can support compressive loads applied by the weight of the roof structure for communication to the footing.

Between the plates 27 and 31 is attached a footing plate 32 which extends from a vertical flange 33 on the inner face of the panels through a horizontal section 34 clamped between the plates and to a downwardly inclined flange portion 35 which is arranged exteriorly of the building and acts as a water shedding device. The plate 32 is an elongate substantially continuous member which bridges between each pile 29 and the next adjacent pile and thus provides a base plate upon which each of the panels is mounted. The inside flange 33 is screwed to the inner face of the panels as indicated at 36 so as to maintain the panels in proper aligned position along the base plate 32.

Similarly at the upper end of the panel is provided a guide plate 37 which similarly includes a downwardly turned flange 38 screwed as indicated at 39 to the upper part of the panel, a horizontal plate portion 40 clamped between the plate 26 of the beam and a further plate 41 of a roof panel described hereinafter. Exteriorly of the building, the overhead plate member 37 includes a troughing portion 42 of conventional construction for acting as an evestroughing. The inner wall of the troughing as indicated at 43 is generally flat and inclined so as to follow the inclined upper surface 171 of the rib 17.

A roof panel is shown in FIGS. 2 and 4 and generally indicated at 44. The roof panel is generally of the same construction as a wall panel including the projections and recesses along the sides, the construction by way of a hollow body as previously described, and a rib (not shown) generally of the same type as the rib 17 with its size being determined by the dimensions of the panel to provide the necessary roof strength. As previously described the roof panels are formed simply from the hollow wall and the optional foam filling. An undersurface of the roof panel follows the angle of the roof as indicated at 44A except that an outermost portion of the undersurface includes a downwardly projecting portion 44B. The bottom surface 44C of the projection 44B is horizontal and sized to match the top surface of the wall panel. A plate indicated at 41 is integrally molded to emerge on the bottom face 44C of the panel 44 as shown in FIG. 4. This plate thus cooperates with the plate 26 at the upper end of the beam 24 by way of bolt 46. The upper end of the panel 44 can include a plate (not shown) mounted in the end face and arranged at an angle to the longitudinal axis of the panel 44 so that the plate can be attached to a similar plate at a ridge in the roof section.

A connection between two roof panels indicated at 44 and 45 is shown in FIG. 5 which basically comprises a projection 47 and a recess 48 similar to the projections and recesses of the wall panels previously described. In this case, however, the recess is formed in a raised portion above the level of the panel itself so that a vertical surface is defined projecting above the level of the panel to prevent moisture passing between the panels since the moisture must first climb the vertical surface before it can pass between the panels.

Suitable openings can be molded in specifically provided window and door panels to act as window and door openings for receiving conventional frames. In one example the panels can be a height sufficient to act as the wall of the building and of the width of the order of three feet thus defining a number of long narrow windows each within a respective one of the panels. In other cases, when the insulation foam is not used, the plastic material used for the molding of the outer skin can be free from coloring material so that it is translucent thus allowing through the transmission of light without the necessity for separate windows for example forming a greenhouse construction.

Other panels may have side edges shaped to define a hamb for a door opening or the like.

The prefabricated structure so formed can be molded readily in a suitable rotational molding machine with each panel being sufficiently light to be easily handled by an operative for loading, transportation and assembly. The assembly can be carried out readily with unskilled labour simply by connection of the panels each to the next while lying upon the ground following which the wall can be raised into place and bolted into location as previously described. Between each panel and the next at the joint, the foam material can be inserted as previously described. Alternatively silicone material can be applied as an effective seal with the surfaces at the sides being chamfered to define a converging recess which can readily accept an injected bead of the silicone material.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A building system comprising a plurality of building panels, each building panel comprising a panel body integrally molded by rotational molding from a synthetic plastics material, said panel body having an outer wall substantially wholly enveloping a hollow interior of the panel body and defining a top surface, two side surfaces, a front surface and a rear surface, the panels each having a height sufficient to extend from a floor level to a roof level of a building, the front surface of at least some of the panels including a longitudinal vertical rib projecting outwardly from the front surface to provide structural strength for the panel so that vertical strength of a wall of a building can be provided solely by the panels, each panel having connecting means on the side surfaces thereof for connection to an adjacent side surface of an adjacent panel wherein the rear surface has a plurality of parallel ribs of less height than said rib on the front surface to allow the attachment of a facing material on the rear surface of the panel body.

2. A building panel comprising a panel body integrally molded from a synthetic plastic material, said panel body having an outer wall substantially wholly enveloping a hollow interior and defining a top surface, a bottom surface, two side surfaces, a front surface and a rear surface, one of said two side surfaces having a recess extending longitudinally of said one side the other of said sides having a projecting portion extending longitudinally of said other side, the recess and projecting portion being correspondingly shaped so that the projecting portion of one panel can only be interconnected with the recess of a next adjacent identical panel by sliding movement in a longitudinal direction of said one panel along a next adjacent panel, the panel body being formed by rotational molding to form a substantially fully closed body with a thickness of the outer wall which is substantially constant and thin relative to the dimensions of the panel body, the front surface including a rib longitudinally of the surface with the rib projecting outwardly from the front surface so as to provide longitudinal structural strength for the panel body and to provide bending resistance for the front surface.

3. The invention according to claim 2 wherein the panel body has a hole molded in an outer surface thereof for the injection into the hollow interior of a foaming material so that the hollow interior can be filled with an insulating foam material.

4. The invention according to claim 2 wherein the rib is arranged centrally of the surface and has a transverse width of the order of $\frac{1}{4}$ to $\frac{1}{3}$ of the width of the panel body.

5. The invention according to claim 2 wherein a height of the rib from the front surface is tapered at the upper and lower ends of the rib so as to converge toward the front surface at the top and bottom of the panel body.

6. The invention according to claim 2 wherein the rear surface has a plurality of ribs of very much less height than said rib on the front surface to allow the attachment of a facing material on the rear surface of the panel body.

7. The invention according to claim 2 wherein the projecting portion and recess are continuous along the sides and are commonly shaped defining a web and a curved bulbous part attached to the web.

8. The invention according to claim 2 wherein at least one of the top and bottom surfaces has a metal plate molded into the surface for fastening to an adjacent structure.

9. A building system comprising a plurality of building panels, each building panel comprising a panel body integrally molded by rotational molding from a synthetic plastics material, said panel body having an outer wall substantially wholly enveloping a hollow interior of the panel body and defining a top surface, two side surfaces, a front surface and a rear surface, the panels each having a height sufficient to extend from a floor level to a roof level of a building, the front surface of at least some of the panels including a longitudinal vertical rib projecting outwardly from the front surface to provide structural strength for the panel so that vertical strength of a wall of a building can be provided solely by the panels, each panel having connecting means on the side surfaces thereof for connection to an adjacent side surface of an adjacent panel wherein, one of said side surfaces has a recess extending longitudinally of said one side and the other of the sides having a projecting portion extending longitudinally of said other side, the recess and projecting portion being correspondingly shaped so that the projecting portion of one panel can only be interconnected with the recess of a next adjacent panel by longitudinal sliding movement of said one panel along said next adjacent panel.

10. The invention according to claim 9 wherein the panel body is formed by rotational molding to form a substantially fully closed body with a thickness of the outer wall which is substantially constant and thin relative to the dimensions of the panel body.

11. The invention according to claim 9 wherein the rib is arranged centrally of the surface and has a transverse width of the order of $\frac{1}{4}$ to $\frac{1}{3}$ of the width of the panel body.

12. The invention according to claim 9 wherein a height of the rib from the front surface is tapered at the upper and lower ends of the rib so as to converge toward the front surface at the top and bottom of the panel body.

13. The invention according to claim 9 wherein the projecting portion and recess are continuous along the sides and are commonly shaped in cross-section to define a web and a curved bulbous part attached to the web.

14. The invention according to claim 9 wherein at least one of the top and bottom surfaces has a metal plate molded into the surface for fastening to an adjacent structure.

15. The invention according to claim 9 including a plurality of corner panels each having a body defining connecting means along side edges thereof and defining a corner such that the side edges are arranged at an angle to one another.

16. The invention according to claim 9 including a plurality of roof panels, each roof panel comprising a panel body integrally molded from a synthetic plastics material, said panel body having an outer wall substantially wholly enveloping an interior thereof, each roof panel defining side surfaces for connecting to an adjacent side surface of an adjacent roof panel, one of the side surfaces including a recess extending longitudinally of said one side and the other of said sides having a projecting portion extending longitudinally of said other side, the recess and projecting portion being correspondingly shaped so that the projecting portion of one panel can be interconnected with the recess of a next adjacent panel only by sliding movement in a longitudinal direction of said one panel along the next adjacent panel, the recesses and projecting portions including at least one surface which extends upwardly from an upper surface of the panel to prevent moisture wicking through the interconnection between said one panel and said next adjacent panel.

17. The invention according to claim 16 wherein at least some of the roof panels include coupling means on an under surface thereof adjacent an end surface thereof for connecting the roof panel to a top surface of a wall panel.

* * * * *